US007750230B2

(12) United States Patent
Akazawa

(10) Patent No.: US 7,750,230 B2
(45) Date of Patent: Jul. 6, 2010

(54) AUTOMATIC RENDITION STYLE DETERMINING APPARATUS AND METHOD

(75) Inventor: Eiji Akazawa, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 717 days.

(21) Appl. No.: 11/228,890

(22) Filed: Sep. 15, 2005

(65) Prior Publication Data

US 2006/0054006 A1 Mar. 16, 2006

(30) Foreign Application Priority Data

Sep. 16, 2004 (JP) ..... 2004-269453

(51) Int. Cl.
*G10H 1/02* (2006.01)
*G10H 1/057* (2006.01)
*G10H 7/00* (2006.01)

(52) U.S. Cl. ..... 84/627; 84/609; 84/645

(58) Field of Classification Search ..... 84/609, 84/622, 659, 627, 645
See application file for complete search history.

(56) References Cited

U.S. PATENT DOCUMENTS 4,332,183 A 6/1982 Deutsch et al.
5,905,223 A 5/1999 Goldstein
6,281,423 B1 * 8/2001 Shimizu et al. ..... 84/622
6,946,595 B2 9/2005 Tamura et al.
2003/0094090 A1 5/2003 Tamura et al.
2003/0154847 A1 8/2003 Akazawa et al.
2003/0177892 A1 9/2003 Akazawa et al.

FOREIGN PATENT DOCUMENTS

JP 2004-070153 3/2004

OTHER PUBLICATIONS

Chinese Office Action mailed May 8, 2009, for CN Application No. 200510103937.2, with English translation, 11 pages.

* cited by examiner

*Primary Examiner*—Jeffrey Donels
*Assistant Examiner*—Andrew R Millikin
(74) *Attorney, Agent, or Firm*—Morrison & Foerster LLP

(57) ABSTRACT

Once performance event information is supplied in real time in accordance with a progression of a performance, a time indicative of temporal relationship between at least two notes to be generated in succession is measured on the basis of the performance event information supplied in real time. Comparison is made between a preset rendition style determination condition including time information and the measured time, and a rendition style that is to be applied to a current tone to be performed in real time is determined on the basis of the comparison result. With the arrangement that a rendition style to be applied to the current tone is determined on the basis of the comparison result, it is possible to execute a real-time performance while automatically expressing a tonguing rendition style.

5 Claims, 4 Drawing Sheets

AUTOMATIC RENDITION STYLE DETERMINING APPARATUS AND METHOD

BACKGROUND OF THE INVENTION

The present invention relates to automatic rendition style determining apparatus and methods for determining musical expressions to be applied on the basis of characteristics of performance data. More particularly, the present invention relates to an improved automatic rendition style determining apparatus and method which, during a real-time performance, permit automatic execution of a performance expressing a so-called "tonguing" rendition style.

Recently, electronic musical instruments have been used extensively which electronically generate tones on the basis of performance data generated as a human player operates a performance operator unit or on the basis of performance data prepared in advance. The performance data used in such electronic musical instruments are organized as MIDI data etc. corresponding to individual notes and musical signs and marks. If pitches of a series of notes are constructed or represented by only tone pitch information, such as note-on and note-off information, an automatic performance or the like of tones, executed by, for example, reproducing the performance data, would become a mechanical and expressionless performance which is therefore musically unnatural. So, there have been known automatic rendition style determining apparatus which, in order to make an automatic performance based on performance data more musically natural, more beautiful and more realistic, permit an automatic performance while determining various musical expressions, corresponding to various rendition styles, on the basis of performance data and automatically imparting the determined rendition styles. One example of such automatic rendition style determining apparatus is disclosed in Japanese Patent Application Laid-open Publication No. 2003-271139. The conventionally-known automatic rendition style determining apparatus automatically determines, on the basis of characteristics of performance data, rendition styles (or articulation) characterized by musical expressions and a musical instrument used and imparts the thus automatically-determined rendition styles (or articulation) to the performance data. For example, the automatic rendition style determining apparatus automatically determines or finds out locations in the performance data where impartment of rendition styles, such as a staccato and legato, is suited, and newly imparts the performance data at the automatically-found locations with performance information capable of realizing or achieving rendition styles, such as a staccato and legato (also called "slur").

To determine a rendition style to be applied to at least two notes that should be generated in succession, the conventionally-shown automatic rendition style determining apparatus is arranged to acquire performance data of a succeeding or second one of the two notes prior to arrival of an original performance time of the second note and then, on the basis of the acquired performance data, determines a rendition style to be applied to the at least two notes (so-called "playback"). Thus, the conventional automatic rendition style determining apparatus has the problem that it is difficult to apply, during a real-time performance, a so-called "tonguing rendition style" (or rendition style representative of a reversal of a bow direction that characteristically occurs during a performance of a stringed instrument). Namely, during a real-time performance, performance data are supplied in real time in accordance with a progression of the real-time performance without being played back. With a rendition style, such as a legato rendition style (or slur rendition style), for sounding at least two notes in succession, performance data (specifically, note-on event data) of the succeeding or second one of the notes can be obtained prior to the end of a performance of the preceding or first one of the notes; thus, a legato rendition style, which is a joint-related rendition style connecting the end of the first note and beginning of the second note, can be applied to the beginning of the second note. However, with a tonguing rendition style or the like where two notes are sounded with an instantaneous break therebetween, it is not possible to acquire performance data (specifically, note-on event data) of the second note at the end of the performance of the first note; thus, it is not possible to make a determination as to which one of an ordinary or normal rendition style and tonguing rendition style should be applied to the beginning of the second note. Therefore, in the case where two successive notes are separated from (i.e., not connected with) each other, it has been conventional to apply a release-related rendition style leading to a silent state and attack-related rendition style rising from a silent state to the end of the first note and beginning of the second note, respectively. Thus, heretofore, even where a tonguing rendition style is applicable, no tonguing rendition style could be actually applied and a normal rendition style would be applied instead of a tonguing rendition style, so that no tonguing rendition style could be expressed during a performance.

SUMMARY OF THE INVENTION

In view of the foregoing, it is an object of the present invention to provide an automatic rendition style determining apparatus and method which determine, on the basis of a time indicative of predetermined time relationship between at least two notes to be generated in succession, a rendition style to be applied to a current note to be performed in real time and thereby permit a real-time performance while automatically expressing a tonguing rendition style.

The present invention provides an improved automatic rendition style determining apparatus, which comprises: a supply section that supplies performance event information in real time in accordance with a progression of a performance; a condition setting section that sets a rendition style determination condition including time information; a time measurement section that measures, on the basis of the performance event information supplied in real time, a time indicative of temporal relationship between at least two notes to be generated in succession; and a rendition style determination section that compares the time information included in the set rendition style determination condition and the measured time and, on the basis of the comparison, determines a rendition style that is to be applied to a current tone to be performed in real time.

Once performance event information is supplied in real time in accordance with a progression of a performance, the time measurement section measures a time indicative of temporal or time relationship between at least two notes to be generated in succession, on the basis of the performance event information supplied in real time. The rendition style determination section compares a rendition style determination condition, including time information, set via the condition setting section and the measured time, and then, on the basis of the comparison result, determines a rendition style that is to be applied to a current tone to be performed in real time. With the arrangement that a rendition style to be applied to the current tone is determined on the basis of the comparison result, it is possible to execute a real-time performance while automatically expressing a tonguing rendition style. Namely, because the present invention determines a rendition style to be applied to the current tone, on the basis of a time indicative of predetermined temporal relationship between at least two notes to be generated in succession from among performance event information supplied in real time, it permits a real-time performance while automatically expressing a tonguing rendition style.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
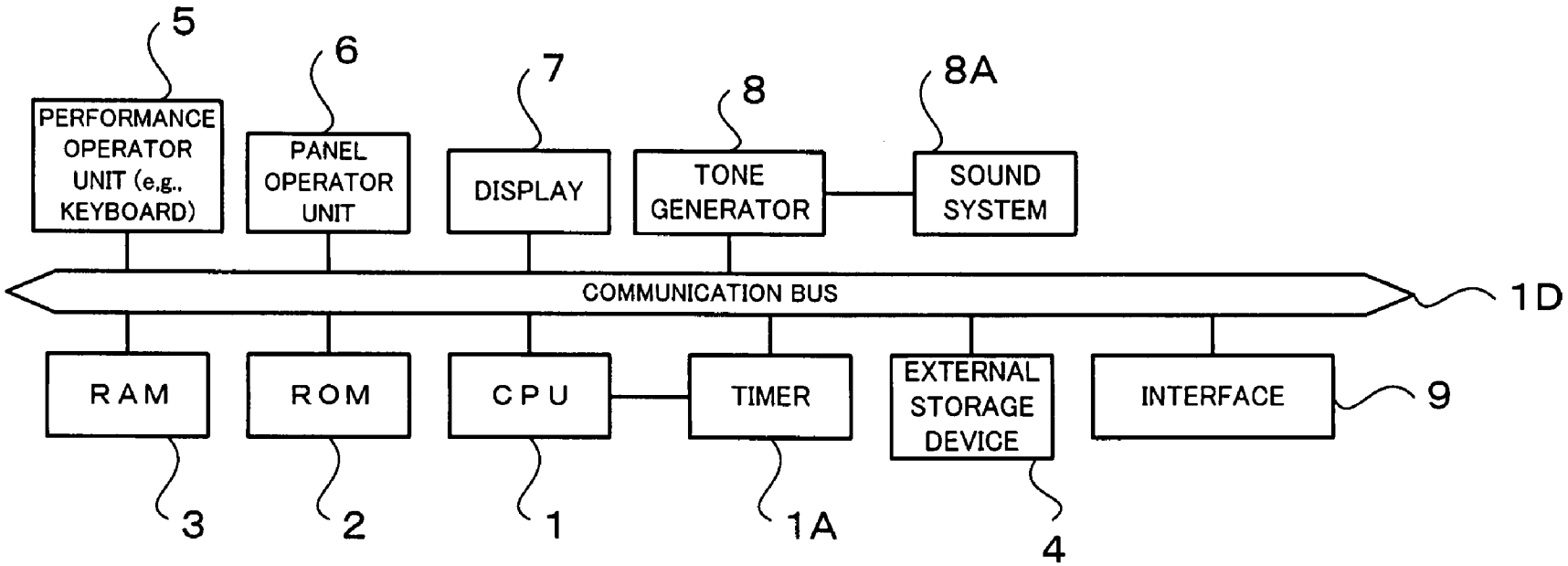
FIG. 1 is a block diagram showing an exemplary hardware organization of an electronic musical instrument employing an automatic rendition style determining apparatus in accordance with an embodiment of the present invention.

FIG. 1 is a block diagram showing an exemplary hardware organization of an electronic musical instrument employing an automatic rendition style determining apparatus in accordance with an embodiment of the present invention. The electronic musical instrument illustrated here is equipped with a performance function for generating electronic tones on the basis of performance data (more specifically, performance event information) supplied in real time in accordance with a progression of a performance based on operation, by a human operator, on a performance operator unit 5, and for successively generating tones of a music piece (or accompaniment on the basis of performance data, including performance event information, supplied in real time in accordance with a performance progression order. The electronic musical instrument is also equipped with a rendition style impartment function which, during execution of the above-mentioned performance function, permits a performance while imparting thereto desired rendition styles, particularly a so-called "tonguing" rendition style in the instant embodiment, in accordance with a result of a rendition style determination; for this purpose, the rendition style impartment function determines a musical expression or rendition style to be newly applied, on the basis of characteristics of the performance data supplied in real time in accordance with a performance progression based on operation, by the human operator, on the performance operator unit 5, or of the performance data sequentially supplied in accordance with a predetermined performance progression order. The so-called tonguing rendition style is a rendition style which characteristically occurs during a performance of a wind instrument, such as a saxophone, and in which the human player changes notes by changing playing fingers the moment the player temporarily blocks the passage of air through the mouthpiece so that a note is sounded with an instantaneous interruption. Other rendition style similar to the tonguing rendition style is one representative of a "reversal of a bow direction" that is carried out during a performance of a stringed instrument, such as a violin. In this specification, rendition styles, musical expressions and the like, including one in which a note is sounded with an instantaneous interruption as by a reversal of a bow direction, will hereinafter referred to as "tonguing rendition styles" for convenience of description.

The electronic musical instrument shown in FIG. 1 is implemented using a computer, where "performance processing" for realizing the above-mentioned performance function and "automatic rendition style determining processing" (see FIG. 4) for realizing the above-mentioned rendition style impartment function are carried out by the computer executing respective predetermined programs (software). Of course, the performance processing and the automatic rendition style determining processing may be implemented by microprograms to be executed by a DSP (Digital Signal Processor), rather than by such computer software. Alternatively, these processing may be implemented by a dedicated hardware apparatus having discrete circuits or integrated or large-scale integrated circuit incorporated therein.

In the electronic musical instrument of FIG. 1, various operations are carried out under control of a microcomputer including a microprocessor unit (CPU) 1, a read-only memory (ROM) 2 and a random access memory (RAM) 3. The CPU 1 controls behavior of the entire electronic musical instrument. To the CPU 1 are connected, via a communication bus (e.g., data and address bus) 1D, the ROM 2, RAM 3, external storage device 4, performance operator unit 5, panel operator unit 6, display device 7, tone generator 8 and interface 9. Also connected to the CPU 1 is a timer A for counting various times, for example, to signal interrupt timing for timer interrupt processes. Namely, the timer 1A generates tempo clock pulses for counting a time interval or setting a performance tempo with which to automatically perform a music piece in accordance with given music piece data. The frequency of the tempo clock pulses is adjustable, for example, via a tempo-setting switch of the panel operator unit 6. Such tempo clock pulses generated by the timer 1A are given to the CPU 1 as processing timing instructions or as interrupt instructions. The CPU 1 carries out various processes in accordance with such instructions. The various processes carried out by the CPU 1 in the instant embodiment include the "automatic rendition style determining processing" (see FIG. 4) for determining whether or not to apply a tonguing rendition style, as a unique rendition style of each musical instrument used, in order to achieve a more natural and more realistic performance. Although the embodiment of the electronic musical instrument may include other hardware than the above-mentioned, it will be described in relation to a case where only minimum necessary resources are employed.

The ROM 2 stores therein various programs to be executed by the CPU 1 and also stores therein, as a waveform memory, various data, such as waveform data (e.g., rendition style modules to be later described in relation to FIG. 2B) corresponding to rendition styles unique to or peculiar to various musical instruments. The RAM 3 is used as a working memory for temporarily storing various data generated as the CPU 1 executes predetermined programs, and/or as a memory for storing a currently-executed program and data related to the currently-executed program. Predetermined address regions of the RAM 3 are allocated to various functions and used as various registers, flags, tables, memories, etc. Similarly to the ROM 2, the external storage device 4 is provided for storing various data, such as performance data to be used for an automatic performance and waveform data corresponding to rendition styles, and various control programs, such as the "automatic rendition style determining processing" (see FIG. 4). Where a particular control program is not prestored in the ROM 2, the control program may be prestored in the external storage device (e.g., hard disk device) 4, so that, by reading the control program from the external storage device 4 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 4 may use any of various removable-type external recording media other than the hard disk (HD), such as a flexible disk (FD), compact disk (CD-ROM or CD-RAM), magneto-optical disk (MO), digital versatile disk (DVD) and semiconductor memory.

The performance operator unit 5 is, for example, in the form of a keyboard including a plurality of keys operable to select pitches of tones to be generated and key switches corresponding to the keys. This performance operator unit 5 can be used not only for a real-time tone performance based on manual playing operation by the human player, but also as input means for selecting a desired one of prestored sets of performance data to be automatically performed. It should be obvious that the performance operator unit 5 may be other than the keyboard type, such as a neck-like device having tone-pitch-selecting strings provided thereon. The panel operator unit 6 includes various operators, such as performance data selecting switches for selecting a desired one of the sets of performance data to be automatically performed and determination condition inputting switches for calling a "determination condition entry screen" (not shown) for entering determination criteria or conditions for determining whether or not to apply a tonguing rendition style (rendition style determination conditions). Of course, the panel operator unit 6 may include other operators, such as a numeric keypad for inputting numerical value data to be used for selecting, setting and controlling tone pitches, colors, effects, etc. for an automatic performance based on performance data, keyboard for inputting text or character data and a mouse for operating a pointer to designate a desired position on any of various screens displayed on the display device 7. For example, the display device 7 comprises a liquid crystal display (LCD), CRT (Cathode Ray Tube) and/or the like, which visually displays various screens in response to operation of the corresponding switches, various information, such as performance data and waveform data, and controlling states of the CPU 1.

The tone generator 8, which is capable of simultaneously generating tone signals in a plurality of tone generation channels, receives performance data supplied via the communication bus 1D and synthesizes tones and generates tone signals on the basis of the received performance data. Namely, as waveform data corresponding to rendition style designating information (rendition style event) included in performance data are read out from the ROM 2 or external storage device 4, the read-out waveform data are delivered via the bus 1D to the tone generator 8 and buffered as necessary. Then, the tone generator 8 outputs the buffered waveform data at a predetermined output sampling frequency. Tone signals generated by the tone generator 8 are subjected to predetermined digital processing performed by a not-shown effect circuit (e.g., DSP (Digital Signal Processor)), and the tone signals having undergone the digital processing are then supplied to a sound system 8A for audible reproduction or sounding.

The interface 9, which is, for example, a MIDI interface or communication interface, is provided for communicating various information between the electronic musical instrument and external performance data generating equipment (not shown). The MIDI interface functions to input performance data of the MIDI standard from the external performance data generating equipment (in this case, other MIDI equipment or the like) to the electronic musical instrument or output performance data of the MIDI standard from the electronic musical instrument to the external performance data generating equipment. The other MIDI equipment may be of any desired type (or operating type), such as the keyboard type, guitar type, wind instrument type, percussion instrument type or gesture type, as long as it can generate data of the MIDI format in response to operation by a user of the equipment. The communication interface is connected to a wired communication network (not shown), such as a LAN, Internet, telephone line network, or wireless communication network (not shown), via which the communication interface is connected to the external performance data generating equipment (in this case, server computer or the like). Thus, the communication interface functions to input various information, such as a control program and performance data, from the server computer to the electronic musical instrument. Namely, the communication interface is used to download particular information, such as a particular control program or performance data set, from the server computer in a case where the particular information is not stored in the ROM 2, external storage device 4 or the like. In such a case, the electronic musical instrument, which is a "client", sends a command to request the server computer to download the particular information, such as a particular control program or performance data set, by way of the communication interface and communication network. In response to the command from the client, the server computer delivers the requested information to the electronic musical instrument via the communication network. The electronic musical instrument receives the particular information via the communication interface and accumulatively store it into the external storage device 4. In this way, the necessary downloading of the particular information is completed.

Note that where the interface 9 is the MIDI interface, it may be a general-purpose interface rather than a dedicated MIDI interface, such as RS232-C, USB (Universal Serial Bus) or IEEE1394, in which case other data than MIDI event data may be communicated at the same time. In the case where such a general-purpose interface as noted above is used as the MIDI interface, the other MIDI equipment connected with the electronic musical instrument may be designed to communicate other data than MIDI event data. Of course, the music information handled in the present invention may be of any other data format than the MIDI format, in which case the MIDI interface and other MIDI equipment are constructed in conformity to the data format used.

Figure 2A:
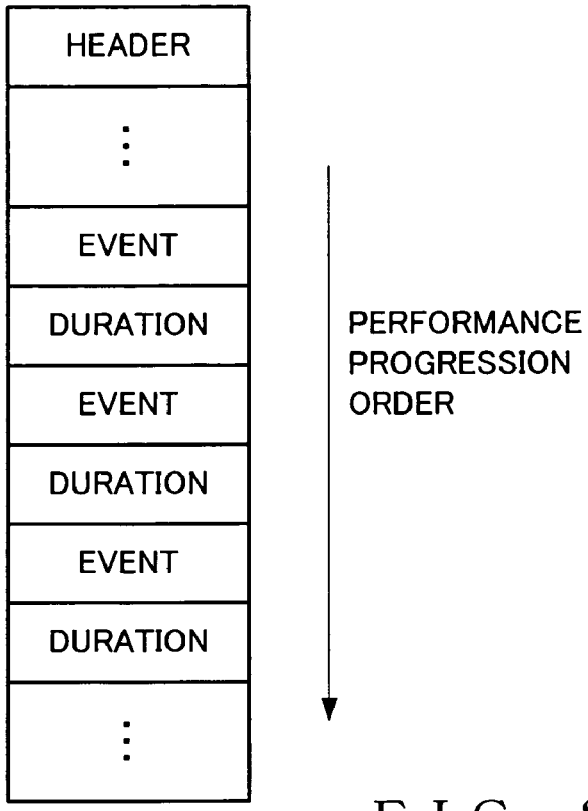
FIG. 2A is a conceptual diagram explanatory of an example of performance data.

Now, a description will be made about the performance data and waveform data stored in the ROM 2, external storage device 4 or the like, with reference to FIG. 2. FIG. 2A is a conceptual diagram explanatory of an example set of performance data.

As shown in FIG. 2A, each performance data set comprises data that are, for example, representative of all tones in a music piece and are stored as a file of the MIDI format, such as an SMF (Standard MIDI File). Performance data in the performance data set comprise combinations of timing data and event data. Each event data is data pertaining to a performance event, such as a note-on event instructing generation of a tone, note-off event instructing deadening or silencing of a tone, or rendition style designating event. Each of the event data is used in combination with timing data. In the instant embodiment, each of the timing data is indicative of a time interval between two successive event data (i.e., duration data); however, the timing data may be of any desired format, such as a format using data indicative of a relative time from a particular time point or an absolute time. Note that, according to the conventional SMF, times are expressed not by seconds or other similar time units, but by ticks that are units obtained by dividing a quarter note into 480 equal parts. Namely, the performance data handled in the instant embodiment may be in any desired format, such as: the "event plus absolute time" format where the time of occurrence of each performance event is represented by an absolute time within the music piece or a measure thereof; the "event plus relative time" format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event. Furthermore, the performance data set may of course be arranged in such a manner that event data are stored separately on a track-by-track basis, rather than being stored in a single row with data of a plurality of tracks stored mixedly, irrespective of their assigned tracks, in the order the event data are to be output. Note that the performance data set may include other data than the event data and timing data, such as tone generator control data (e.g., data for controlling tone volume and the like).

This and following paragraphs describe the waveform data handled in the instant embodiment. FIG. 2B is a schematic view explanatory of examples of waveform data. Note that FIG. 2B shows examples of waveform data suitable for use in a tone generator that uses a tone waveform control technique called "AEM (Articulation Element Modeling)" (so-called "AEM tone generator"); the AEM is intended to perform realistic reproduction and reproduction control of various rendition styles peculiar to various natural musical instruments or rendition styles faithfully expressing articulation-based tone color variations, by prestoring entire waveforms corresponding to various rendition styles (hereinafter referred to as "rendition style modules") in partial sections, such as an attack portion, release portion, body portion, etc. of each individual tone.

In the ROM 2, external storage device 4 and/or the like, there are stored, as "rendition style modules", a multiplicity of original rendition style waveform data sets and related data groups for reproducing waveforms corresponding to various rendition styles peculiar to various musical instruments. Note that each of the rendition style modules is a rendition style waveform unit that can be processed as a single data block in a rendition style waveform synthesis system; in other words, each of the rendition style modules is a rendition style waveform unit that can be processed as a single event. As seen from FIG. 2B, the rendition style waveform data sets of the various rendition style modules include in terms of characteristics of rendition styles of performance tones: those defined in correspondence with partial sections of each performance tone, such as attack, body and release portions (attack-related, body-related and release-related rendition style modules); and those defined in correspondence with joint sections between successive tones such as a slur (joint-related rendition style modules).

Such rendition style modules can be classified into several major types on the basis of characteristics of the rendition styles, time wise segments or sections of performances, etc. For example, the following are five major types of rendition style modules thus classified in the instant embodiment:

1) "Normal Head" (abbreviated NH): This is an attack-related rendition style module representative of and hence applicable to) a rise portion (i.e., attack portion) of a tone from a silent state;
2) "Normal Finish" (abbreviated NF): This is a release related rendition style module representative of (and hence applicable to) a fall portion (i.e., release portion) of a tone leading to a silent state;
3) "Slur Joint" (abbreviated SJ): This is a joint-related rendition style module representative of (and hence applicable to) a joint portion interconnecting two successive tones by a slur with no intervening silent state;
4) "Normal Body" (abbreviated NB): This is a body-related rendition style module representative of (and hence applicable to) a body portion of a tone in between rise and fall portions;
5) "Joint Head" (abbreviated JH): This is an attack-related rendition style module representative of (and hence applicable to) a rise portion of a tone realizing a tonguing rendition style that is a special kind of rendition style different from a normal attack portion.

It should be appreciated here that the classification into the above five rendition style module types is just illustrative, and the classification of the rendition style modules may of course be made in any other suitable manner; for example, the rendition style modules may be classified into more than five types. Further, the rendition style modules may also be classified for each original tone source, such as a human player, type of musical instrument or performance genre.

Further, in the instant embodiment, the data of each rendition style waveform corresponding to one rendition style module are stored in a database as a data set of a plurality of waveform-constituting factors or elements, rather than being stored merely as originally input; each of the waveform-constituting elements will hereinafter be called a vector. As an example, each rendition style module includes the following vectors. Note that "harmonic" and "nonharmonic" components are defined here by separating an original rendition style waveform in question into a waveform segment having a pitch-harmonious component (harmonic component) and the remaining waveform segment having a non-pitch-harmonious component (nonharmonic component).

1) Waveform shape (timbre) vector of the harmonic component: This vector represents only a characteristic of a waveform shape extracted from among the various waveform-constituting elements of the harmonic component and normalized in pitch and amplitude.

2) Amplitude vector of the harmonic component: This vector represents a characteristic of an amplitude envelope extracted from among the waveform-constituting elements of the harmonic component.

3) Pitch vector of the harmonic component: This vector represents a characteristic of a pitch extracted from among the waveform-constituting elements of the harmonic component; for example, it represents a characteristic of timewise pitch fluctuation relative to a given reference pitch.

4) Waveform shape (timbre) vector of the nonharmonic component: This vector represents only a characteristic of a waveform shape (noise-like waveform shape) extracted from among the waveform-constituting elements of the nonharmonic component and normalized in amplitude.

5) Amplitude vector of the nonharmonic component: This vector represents a characteristic of an amplitude envelope extracted from among the waveform-constituting elements of the nonharmonic component.

The rendition style waveform data of the rendition style module may include one or more other types of vectors, such as a time vector indicative of a time-axial progression of the waveform, although not specifically described here.

For synthesis of a rendition style waveform, waveforms or envelopes corresponding to various constituent elements of the rendition style waveform are constructed along a reproduction time axis of a performance tone by applying appropriate processing to these vector data in accordance with control data and arranging or allotting the thus-processed vector data on or to the time axis and then carrying out a predetermined waveform synthesis process on the basis of the vector data allotted to the time axis. For example, in order to produce a desired performance tone waveform, i.e. a desired rendition style waveform exhibiting predetermined ultimate rendition style characteristics, a waveform segment of the harmonic component is produced by imparting a harmonic component's waveform shape vector with a pitch and time variation characteristic thereof corresponding to a harmonic component's pitch vector and an amplitude and time variation characteristic thereof corresponding to a harmonic component's amplitude vector, and a waveform segment of the nonharmonic component is produced by imparting a nonharmonic component's waveform shape vector with an amplitude and time variation characteristic thereof corresponding to a nonharmonic component's amplitude vector. Then, the desired performance tone waveform can be produced by additively synthesizing the thus-produced harmonic and nonharmonic components' waveform segments.

Figure 2B:
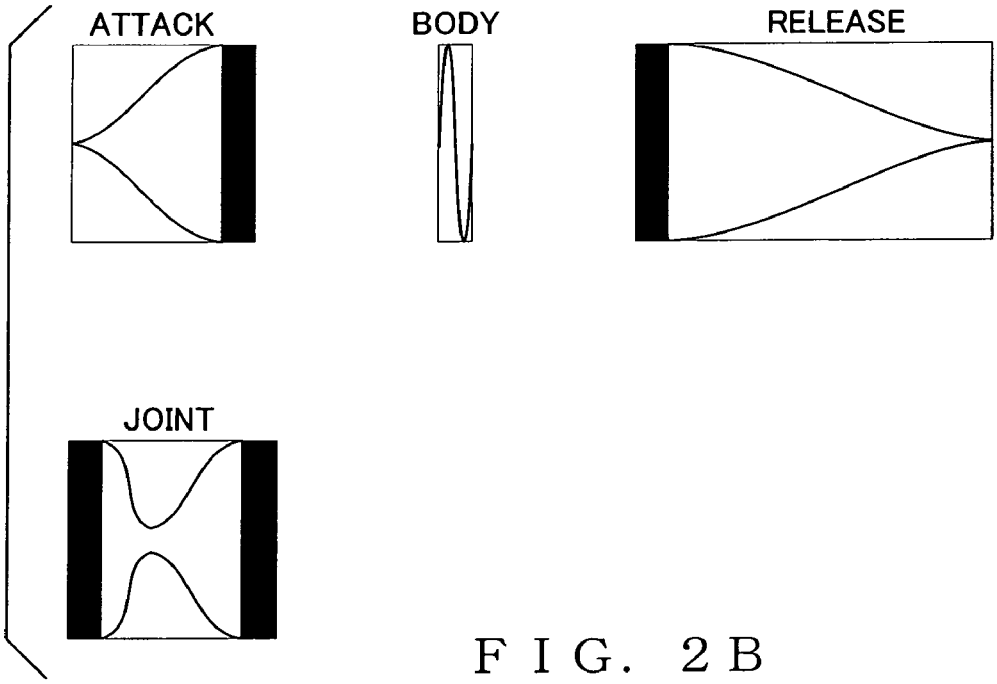
FIG. 2B is a conceptual diagram explanatory of examples of waveform data.

Each of the rendition style modules comprises data including rendition style waveform data as illustrated in FIG. 2B and rendition style parameters. The rendition style parameters are parameters for controlling the time, level etc. of the waveform represented by the rendition style module. The rendition style parameters may include one or more kinds of parameters that depend on the nature of the rendition style module in question. For example, the "Normal Head" or "Joint Head" rendition style module may include different kinds of rendition style parameters, such as an absolute tone pitch and tone volume immediately after the beginning of generation of a tone, the "Normal Body" rendition style module may include different kinds of rendition style parameters, such as an absolute tone pitch of the module, start and end times of the normal body and dynamics at the ginning and end of the normal body. These "rendition style parameters" may be prestored in the ROM 2 or the like, or may be entered by user's input operation. The existing rendition style parameters may be modified via user operation. Further, in a situation where no rendition style parameter is given at the time of reproduction of a rendition style waveform, predetermined standard rendition style parameters may be automatically imparted. Furthermore, suitable parameters may be automatically produced and imparted in the course of processing.

Figure 3:
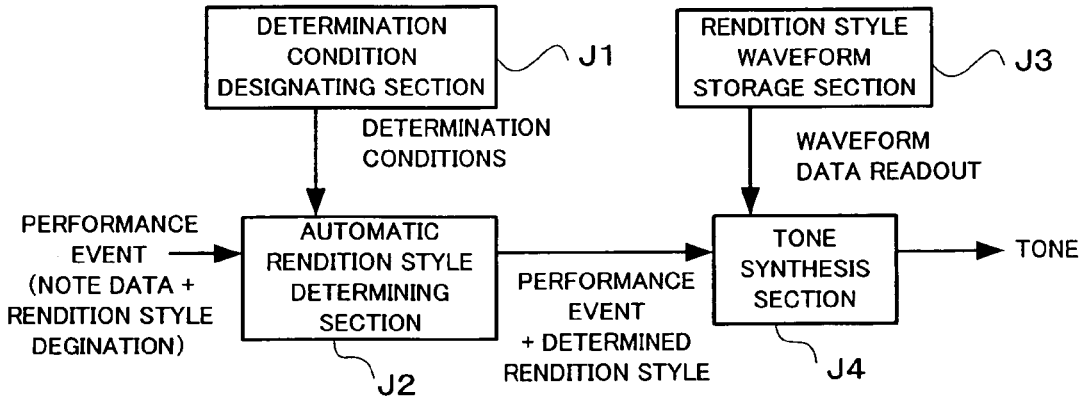
FIG. 3 is a functional block diagram explanatory of an automatic rendition style determining function and performance function performed by the electronic musical instrument.

The electronic musical instrument shown in FIG. 1 has not only the performance function for successfully generating tones of a music piece (or accompaniment) on the basis of performance data generated in response to operation, by the human player, on the performance operator unit 5 or on the basis of previously prepared performance data, but also the rendition style impartment function for, during execution of the above-mentioned performance function, permitting a performance while imparting thereto a so-called "tonguing" rendition style by making a musical expression determination (or rendition style determination) on the basis of characteristics of the performance data supplied in real time. General description of these functions will be given below with reference to FIG. 3. FIG. 3 is a functional block diagram explanatory of the automatic rendition style determining function and performance function performed by the electronic musical instrument, where data flows between various components are indicated by arrows.

In FIG. 3, a determination condition designating section J1 shows the "determination condition entry screen" (not shown) on the display device 7 in response to operation of the determination condition entry switches and accepts user's entry of determination conditions for rendition style impartment. Once the performance function is started, performance information is sequentially supplied in real time in response to human player's operation on the operator unit 5, or sequentially supplied from designated performance data in accordance with the performance progression order. The supplied performance data include at least performance event information, such as information of note-on and note-off events (these events will be generically referred to as "note data"). Real-time performance is executed by the performance event information being supplied in real time in accordance with the performance progression order. Automatic rendition style determination section J2 carries out the "automatic rendition style determining processing" (see FIG. 4 to be later described) to automatically impart rendition styles to the supplied performance event information. Namely, the automatic rendition style determination section J2 determines, in accordance with the determination conditions given from the determination condition designating section J1, whether or not a predetermined rendition style is to be newly imparted only to notes for which no rendition style is designated in the performance event information. If it has been determined that a predetermined rendition style is to be newly imparted, the automatic rendition style determination section J2 imparts the predetermined rendition style to the performance event information and then outputs the resultant rendition-style-imparted performance event information to a tone synthesis section J4. On the basis of the rendition-style-imparted performance event information output from the automatic rendition style determination section J2, the tone synthesis section J4 reads out, from a rendition style waveform storage section (waveform memory) J3, waveform data for realizing or achieving the rendition style and thereby synthesize and output a tone. Namely, the electronic musical instrument of the invention synthesizes tones while applying determined rendition styles. Thus, in the case where the tone generator 8 is an AEM tone generator or the like having a rendition-style support function, it is possible to achieve a high-quality rendition style expression by passing rendition style designating information, obtained as a result of the above-mentioned determination, to the tone generator 8. If, on the other hand, the tone generator 8 has no rendition-style support function, it is of course possible to achieve a rendition style expression by changing the waveform or passing tone generator control information, designating an envelope or other shape etc., to the tone generator 8.

Figure 4:
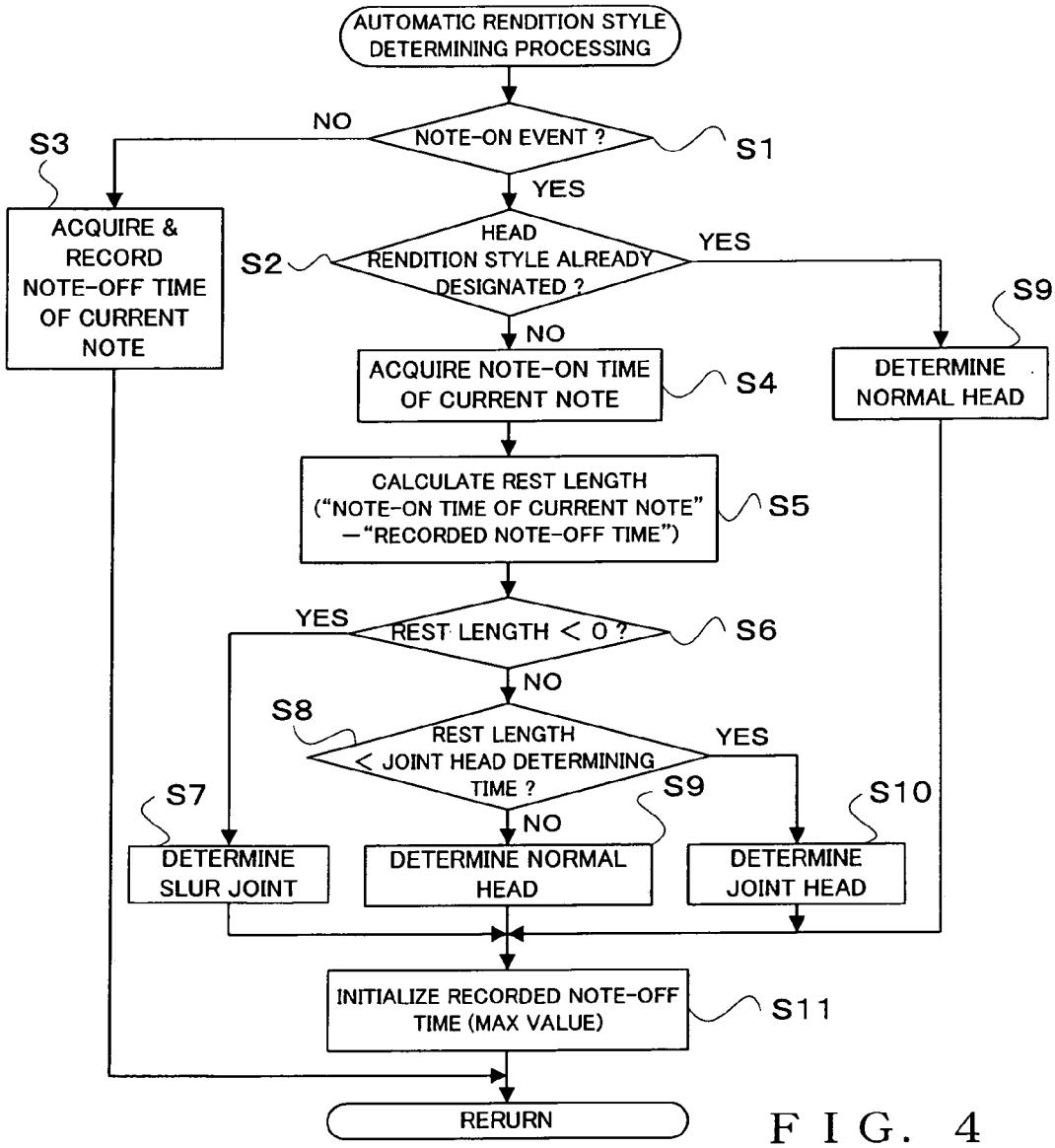
FIG. 4 is a flow chart showing an embodiment of automatic rendition style determining processing carried out in the electronic musical instrument.

As noted above, if performance data are composed only of time, note length and tone pitch information of a series of notes, a mechanical and expressionless performance, which is often musically unnatural, would be reproduced on the basis of the performance data. The automatic rendition achieve a real-time performance where peculiar characters of a musical instrument used are expressed more effectively, by automatically imparting performance data, supplied in real time, with performance information pertaining to a tonguing rendition style. So, with reference to FIG. 4, the following paragraphs detail the "automatic rendition style determining processing" for automatically imparting a tonguing rendition style to performance data supplied in real time. FIG. 4 is a flow chart showing an embodiment of the "automatic rendition style determining processing" carried out by the CPU 1 in the electronic musical instrument. The "automatic rendition style determining processing" is performed by the CPU 1 in response to, for example, operation of an "automatic expression impartment start switch" on the panel operator unit 6.

First, at step S1, a determination is made as to whether or not the supplied performance event information is indicative of a note-on event. If the supplied performance event information is indicative of a note-off event rather than a note-on event (NO determination at step S1), a note-off time of the current note is acquired and recorded at step S3. If, on the other hand, the supplied performance event information is indicative of a note-on event (YES determination at step S1), the CPU 1 goes to step S2, where a further determination is made as to whether a head rendition style has already been designated. Namely, in generating a new tone (herein also referred to as "current note"), a determination is made as to whether a rendition style designating event that designates a rendition style of the attack portion (i.e., head rendition style) has already been designated. If such a head rendition style has already been designated (YES determination at step S2), there is no need to automatically impart a new particular rendition style, and thus, the designated head rendition style is determined to be a rendition style that is to be currently imparted (step S9). After that, the CPU 1 jumps to step S111 In this case, the supplied rendition style designating event is sent as-is to the tone synthesis section J4. If no head rendition style has been designated yet (NO determination at step S2), a note-on time of the current note is acquired at step S4. Then, at step S5, the recorded note-off time is subtracted from the acquired note-on time of the current note, to thereby calculate a length of a rest between the last note and the current note (step S5). Namely, step S5 calculates a time length from the performance end of the tone represented by the preceding or last note to the performance start of the tone represented by the current note.

At following step S6, a further determination is made as to whether the rest length, calculated at step S5, is smaller than "0". If the calculated rest length is of a negative value smaller than "0" (YES determination at step S6), i.e. if the two successive notes overlap with each other, it is judged that the current note is continuously connected with the last note by a slur, it is determined that a slur joint rendition style, one of joint-related rendition style modules, should be used (step S7). If, on the other hand, the calculated rest length is not smaller than "0" (NO determination at step S6), i.e. if the two successive notes do not overlap with each other, a further determination is made, at step S8, as to whether or not the calculated rest length is shorter than the joint head determining time. Here, the joint head determining time is a preset time length differing per human player, musical instrument type and performance genre. If it has been determined that the calculated rest length is not shorter than the joint head determining time (NO determination at step S8), then it is judged that the current note represents a tone that should not be imparted with a tonguing rendition style, and that the rendition style module to be used here as an attach-related rendition style is a normal head rendition style (step S9). If, on the other hand, it has been determined that the calculated rest length is shorter than the joint head determining time (YES determination at step S8), it is judged that the current note represents a tone that should be imparted with a tonguing rendition style, and that the rendition style module to be used here as an attach-related rendition style is a joint head rendition style (step S10). At next step S11, the recorded note-off time is initialized. In the instant embodiment, the initialization of the recorded note-off time may be by setting the recorded note-off time to a maximum value.

Figure 5A:
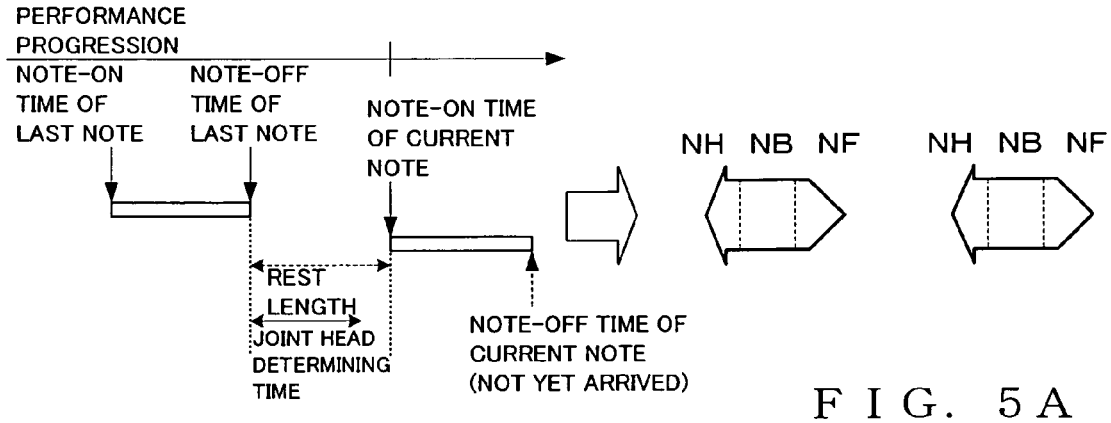
FIGS. 5A-5C are diagrams showing waveforms of tones generated in correspondence with various different rest lengths from a last note to a current note.

Now, with reference to FIG. 5, a description will be made about waveforms ultimately generated on the basis of various results of the rendition style determinations made in the "automatic rendition style determining processing" (FIG. 4). FIGS. 5A-5C are conceptual diagrams showing tone waveforms generated in accordance with different rest lengths from the last note to the current note immediately following the last note. In FIGS. 5A-5C, temporal or time relationship between the determination conditions and the rest lengths is illustrated on left side areas of the figures while waveforms generated on the determined rendition styles are illustrated as envelope waveforms on right side areas of the figures.

If the time length (i.e., rest length) from the note-off time of the last note to the note-on time of the current note (i.e., time length from the end of the last note whose length is represented by a horizontally-elongated rectangle in the figure to the beginning of the current note whose length is also represented by a horizontally-elongated rectangle) is longer than the joint head determining time, a normal head rendition style is selected (see step S9 of FIG. 4). Thus, in this case, each of the notes is expressed by a combination of normal head (NH), normal body (NB) and normal finish (NF) rendition style modules as illustrated in FIG. 5A, and it is expressed as a waveform of an independent tone not connected with the other note by a joint rendition style module. If the rest length between the successive notes is smaller than "0", a slur joint rendition style is selected (see step S7 of FIG. 4). Thus, in this case, waveforms of the successive notes are expressed by a combination of normal head (NH), normal bodies (NB) and normal finish (NF) rendition style modules with the normal finish rendition style module of the preceding or last note and the normal head rendition style module of the succeeding or current note replaced with a slur joint (SJ) rendition style module, as illustrated in FIG. 5B. If the rest length between the successive notes is longer than the joint head determining time, a joint head rendition style is selected as an attack-related rendition style (see step S10 of FIG. 4). Thus, in this case, the preceding note is expressed as a waveform of an independent tone by a combination of normal head (NH), normal body (NB) and normal finish (NF) rendition style modules while the succeeding or current note is expressed as a waveform of an independent tone, representing a tonguing rendition style, by a combination of a joint head (JH), normal body (NB) and normal finish (NF) rendition style modules as illustrated in FIG. 5C.

Figure 5B:
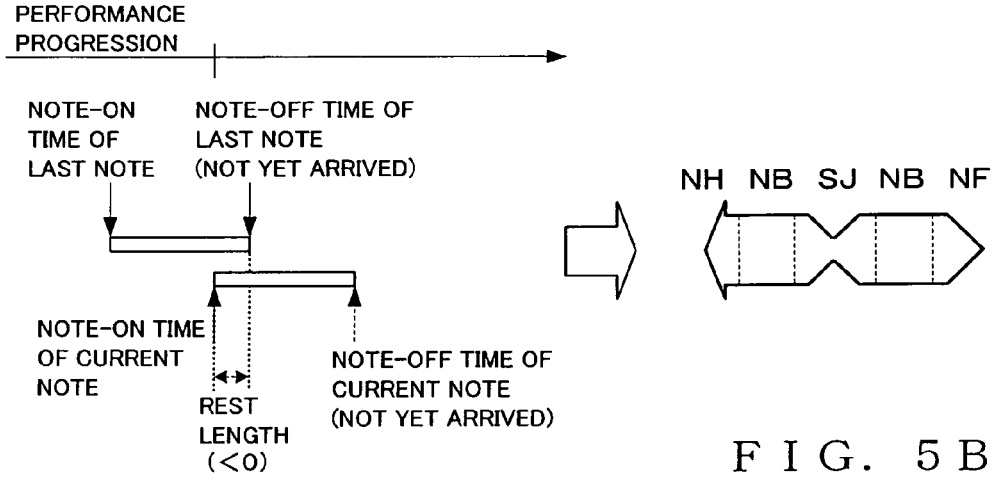
Figure 5C:
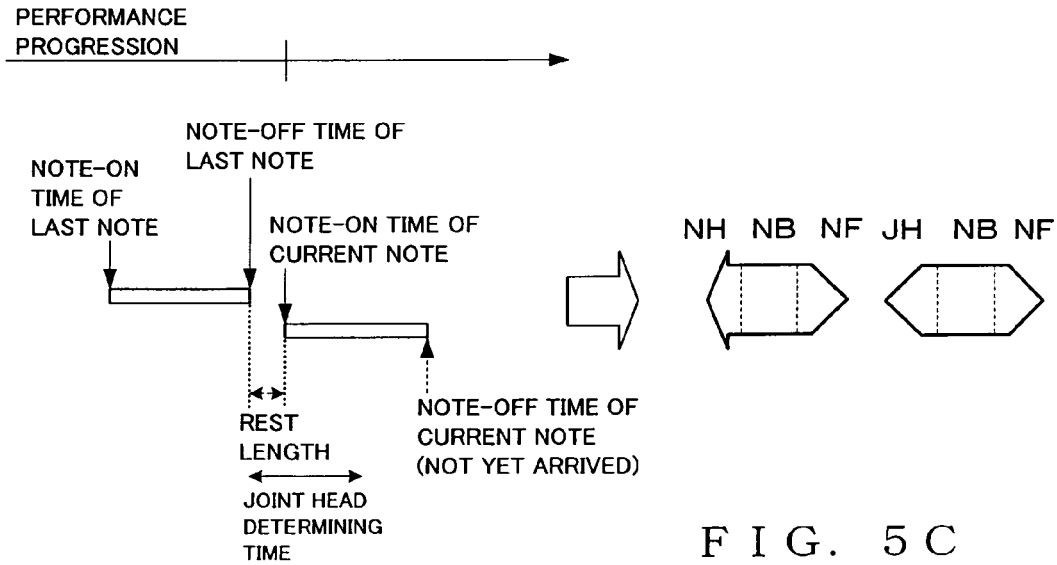

When the performance has progressed further from the note-on time of the current note in the illustrated example of FIG. 5B, the automatic rendition style determining processing acquires the note-off time of the last note (see step S3 of FIG. 4). In this case, however, subsequent operations may be carried out, with the acquired note-off time of the last note ignored, to determine a rendition style to be applied in accordance with relationship with the next note.

Namely, in the case where a rest length between successive notes in performance data, to which no rendition style has been imparted, is longer than the joint head determining time, the note succeeding the last note ended with a normal finish rendition style module is started with a normal head rendition style module, and each of the successive notes is expressed as a waveform of an independent tone. In the case where the rest length the between the successive notes is shorter than the joint head determining time, the note succeeding the last note ended with the normal finish rendition style module is started with a joint head rendition style module, and each of the successive notes is expressed as a waveform of an independent tone. Further, in the case where the rest length the between successive notes is smaller than "0", the successive notes are expressed as a continuous waveform using a slur joint rendition style module. In this way, a tone of an entire note (or successive notes) is synthesized by a combination of an attack-related rendition style module, body-related rendition style module and release-related rendition style module (or joint-related rendition style module).

Namely, during a real-time performance, the instant embodiment can determine which one of a tonguing rendition style (joint head) and normal attack rendition style (normal head) should be applied, by comparing time relationship between the note-off time of the last note immediately preceding the current note event and the note-on time of the current note with time information included in the rendition style determining conditions. By preparing joint heads for achieving tonguing rendition styles separately from normal heads with a normal attack and using appropriate one of joint head data differing from each other depending on the pitch interval, time difference etc. between the current note and the last note, the instant embodiment can express more realistic tonguing rendition styles.

Needless to say, although each of the embodiments has been described above in relation to the case where the software tone generator generates a single tone at one time in a monophonic mode, it may be applied to a case where the software tone generator generates a plurality of tones at one time in a polyphonic mode. Further, performance data arranged in the polyphonic mode may be broken down into a plurality of monophonic sequences so that these monophonic sequences are processed by a plurality of automatic rendition style determining functions. In such a case, the broken-down results may be displayed on the display device 7 so that the user can confirm and modify the broken-down results as necessary.

It should also be appreciated that the waveform data employed in the present invention may be other than those constructed using rendition style modules as described above, such as waveform data sampled using the PCM, DPCM, ADPCM or other scheme. Namely, the tone generator 8 may employ any of the known tone signal generation techniques such as: the memory readout method where tone waveform sample value data stored in a waveform memory are sequentially read out in accordance with address data varying in response to the pitch of a tone to be generated; the FM method where tone waveform sample value data are acquired by performing predetermined frequency modulation operations using the above-mentioned address data as phase angle parameter data; and the AM method where tone waveform sample value data are acquired by performing predetermined amplitude modulation operations using the above-mentioned address data as phase angle parameter data. Other than the above-mentioned, the tone generator 8 may use the physical model method, harmonics synthesis method, formant synthesis method, analog synthesizer method using VCO, VCF and VCA, analog simulation method, or the like. Further, instead of constructing the tone generator 8 using dedicated hardware, tone generator circuitry 8 may be constructed using a combination of the DSP and microprograms or a combination of the CPU and software. Furthermore, a plurality of tone generation channels may be implemented either by using a single circuit on a time-divisional basis or by providing a separate circuit for each of the channels.

In the case where the above-described rendition style determining apparatus of the invention is applied to an electronic musical instrument as above, the electronic musical instrument may be of any type other than the keyboard instrument type, such as a stringed, wind or percussion instrument type. The present invention is of course applicable not only to such an electronic musical instrument where all of the performance operator unit, display device, tone generator, etc. are incorporated together within the musical instrument, but also to another type of electronic musical instrument where the above-mentioned performance operator unit, display device, tone generator, etc. are provided separately and interconnected via communication facilities such as a MIDI interface, various networks and the like. Further, the rendition style determining apparatus of the present invention may comprise a combination of a personal computer and application software, in which case various processing programs may be supplied to the apparatus from a storage media such as a magnetic disk, optical disk or semiconductor memory or via a communication network. Furthermore, the rendition style determining apparatus of the present invention may be applied to karaoke apparatus, automatic performance devices like player pianos, electronic game devices, portable communication terminals like portable phones, etc. Further, in the case where the rendition style determining apparatus of the present invention is applied to a portable communication terminal, part of the functions of the portable communication terminal may be performed by a server computer so that the necessary functions can be performed cooperatively by the portable communication terminal and server computer. Namely, the rendition style determining apparatus of the present invention may be constructed in any desired manner as long as it permits generation of tones during a real-time performance while automatically imparting a tonguing rendition style.

What is claimed is:

1. An automatic rendition style determining apparatus comprising:

a supply section that supplies performance event information in real time in accordance with a progression of a performance;

a condition setting section that sets a rendition style determination condition including time information;

a time measurement section that measures, on the basis of the performance event information supplied in real time by said supply section, a time length of a rest between at least two notes to be generated in succession; and a rendition style determination section that makes a comparison between the time information included in the rendition style determination condition set by said condition setting section and the time length measured by said time measurement section and, on the basis of the comparison, determines a rendition style that is to be applied to an attack portion of a current tone to be performed in real time immediately after the rest, wherein said rendition style determination section determines the rendition style by selecting any one of a normal rendition style, slur joint rendition style and tonguing rendition style, wherein the slur joint rendition style is a rendition style where at least two successive notes are interconnected by a slur with no intervening silent state and the tonguing rendition style is a rendition style where at least two successive notes are sounded with an instantaneous break therebetween.

2. An automatic rendition style determining apparatus as claimed in claim 1 which further comprises a storage section that temporarily stores information indicative of a supplied time of a note-off event included in the performance event information supplied in real time, and wherein said time measurement section measures a time from a supplied time of a note-on event supplied in real time, as performance event information, by said supply section to the supplied time of the note-off event of a preceding note, sounded immediately before said note-on event supplied in real time temporarily stored in said storage section.

3. An automatic rendition style determining apparatus as claimed in claim 1 wherein, when a rendition style designating event that instructs a predetermined rendition style is not included in the performance event information supplied in real time, said rendition style determination section determines a rendition style that is to be applied to a current tone to be performed in real time.

4. An automatic rendition style determining apparatus as claimed in claim 1 wherein said rendition style determination section determines at least a tonguing rendition style as the rendition style that is to be applied to an attack portion of a current tone to be performed in real time immediately after the rest.

5. A computer-readable storage medium containing a program containing a group of instructions for causing a computer to perform an automatic rendition style determining procedure, said automatic rendition style determining procedure comprising:

a step of supplying performance event information in real time in accordance with a progression of a performance;

a step of setting a rendition style determination condition including time information;

a step of measuring, on the basis of the performance event information supplied in real time by said step of supplying, a time length of a rest between at least two notes to be generated in succession; and a step of making a comparison between the time information included in the rendition style determination condition set by said step of setting and the time length measured by said step of measuring and, on the basis of the comparison, determining a rendition style that is to be applied to an attack portion of a current tone to be performed in real time immediately after the rest, wherein said rendition style determination section determines the rendition style by selecting any one of a normal rendition style, slur joint rendition style and tonguing rendition style, wherein the slur joint rendition style is a rendition style where at least two successive notes are interconnected by a slur with no intervening silent state and the tonguing rendition style is a rendition style where at least two successive notes are sounded with an instantaneous break therebetween.

* * * * *